US012121081B2

(12) United States Patent
Robell

(10) Patent No.: US 12,121,081 B2
(45) **Date of Patent: *Oct. 22, 2024**

(54) SMART SPORTS JERSEY

(71) Applicant: Glenn Robell, Peoria, AZ (US)

(72) Inventor: Glenn Robell, Peoria, AZ (US)

(73) Assignee: AI FANWEAR LLC, Northridge, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/513,551

(22) Filed: Nov. 18, 2023

(65) Prior Publication Data

US 2024/0260685 A1 Aug. 8, 2024

Related U.S. Application Data

(63) Continuation of application No. 18/105,831, filed on Feb. 4, 2023, now Pat. No. 11,819,067.

(51) Int. Cl.
*A41D 13/00* (2006.01)

(52) U.S. Cl.
CPC ..... *A41D 13/0015* (2013.01)

(58) Field of Classification Search
CPC ..... A41D 13/0015; A41D 1/04; A41D 27/08; A41D 29/00
See application file for complete search history.

(56) References Cited

U.S. PATENT DOCUMENTS

| | | | | |
|---|---|---|---|---|
| 10,244,802 | B2 * | 4/2019 | Gibson | A41D 27/08 |
| 11,819,067 | B1 * | 11/2023 | Robell | A41D 27/085 |
| 2009/0007310 | A1 * | 1/2009 | Armour | G09F 21/02 2/244 |
| 2012/0284894 | A1 * | 11/2012 | Brown | A41D 13/0015 2/69 |
| 2014/0180869 | A1 * | 6/2014 | Kurucza | A41D 1/02 2/93 |
| 2014/0189929 | A1 * | 7/2014 | Gooch | A41D 27/08 2/69 |
| 2016/0174614 | A1 * | 6/2016 | Kimmet | A41B 1/08 2/116 |
| 2017/0360128 | A1 * | 12/2017 | Brinkmann | A41D 13/0015 |
| 2018/0027889 | A1 * | 2/2018 | Frost | A41D 3/00 |
| 2018/0098587 | A1 * | 4/2018 | Moore | A43B 23/0205 |

* cited by examiner

*Primary Examiner* — Tajash D Patel
(74) *Attorney, Agent, or Firm* — Edmond DeFrank

(57) ABSTRACT

The embodiments disclose a multi-team sports jersey including a first sports jersey pattern section displaying a first insignia of a first sports team, wherein the first insignia includes the first sports team colors and a first sports team player number, and wherein the first section is located on a front section panel and a right sleeve section of the sports jersey, a second sports jersey pattern section displaying a second insignia of a second sports team, wherein the second insignia includes second sports team colors and a second sports team player number, and wherein the second section is located on a back section panel and a left sleeve section of the sports jersey, a stitched seam separating the first section from the second section, and wherein the first team colors of the first sports team are different from the second team colors of the second sports team.

20 Claims, 16 Drawing Sheets

SMART SPORTS JERSEY

This Patent Application is a Continuation and claims priority to United States Patent Application entitled: "MULTI-TEAM SPORTS JERSEY", U.S. Ser. No. 18/105,831 filed on Feb. 4, 2023 filed by Glenn Robell, the U.S. Patent Application being incorporated herein by reference.

BACKGROUND

Many sports fans are supporters of more than one team and more than one sport. However, a sports jersey shirt typically only shows one team in a single sport. Sports fans enjoy sharing their enthusiasm with others in all types of weather conditions. What they are missing is a multi-team sports jersey shirt that displays their enthusiasm for the multiple teams and sports and is suitable for any type of weather conditions.

DETAILED DESCRIPTION OF THE INVENTION

In a following description, reference is made to the accompanying drawings, which form a part hereof, and which are shown by way of illustration a specific example in which the invention may be practiced. It is to be understood that other embodiments may be utilized and structural changes may be made without departing from the scope of the present invention.

General Overview:

It should be noted that the descriptions that follow, for example, in terms of a multi-team sports jersey are described for illustrative purposes and the underlying system can apply to any number and multiple types of sports-related garments. In one embodiment of the present invention, the multi-team sports jersey can be configured using multiple team names. The multi-team sports jersey can be configured to include team colors and can be configured to include player numbers using the present invention.

Figure 1:
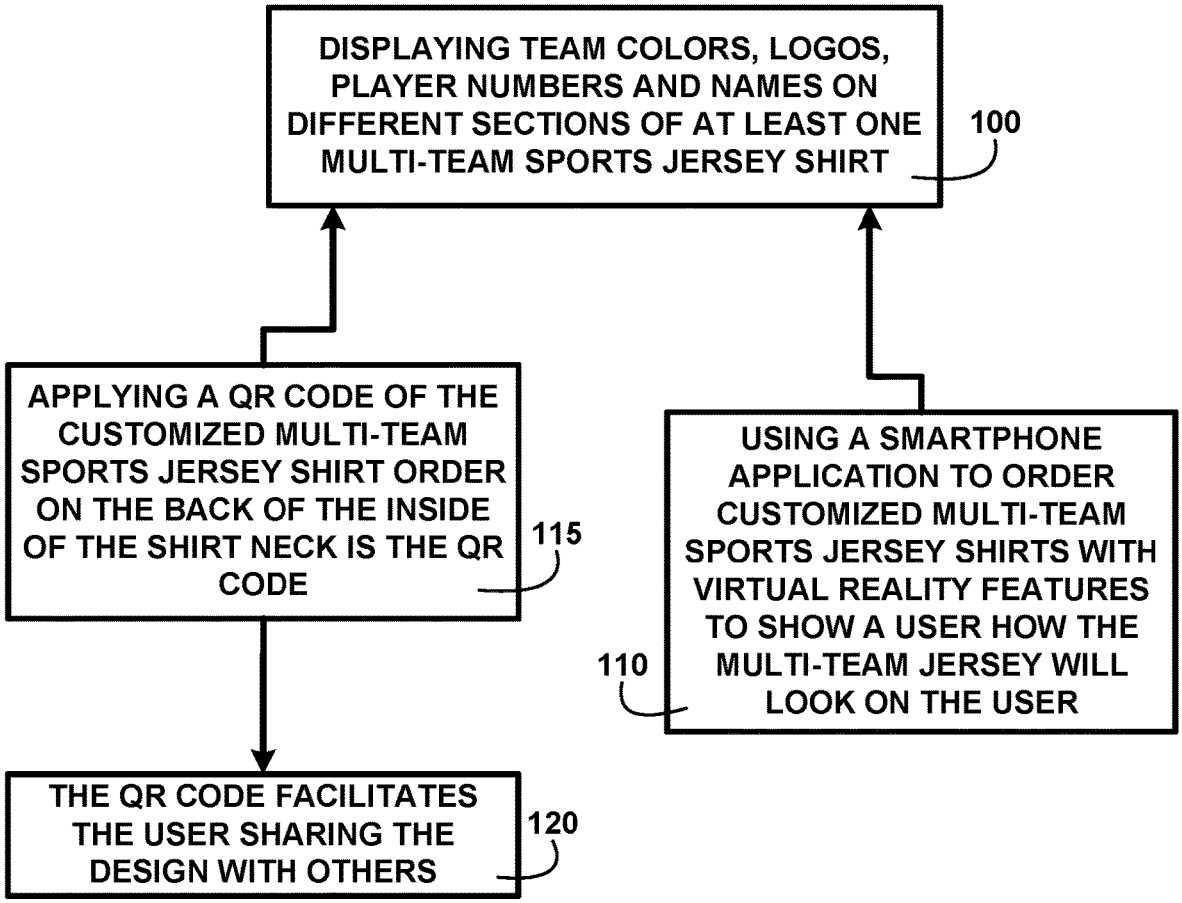
FIG. 1 shows a block diagram of an overview flow chart of a multi-team sports jersey of one embodiment.

FIG. 1 shows a block diagram of an overview flow chart of a multi-team sports jersey of one embodiment. FIG. 1 shows a multi-team sports jersey displaying team colors, logos, player numbers, and names on different sections of at least one multi-team sports jersey shirt 100. Using a smartphone app to order customized multi-team sports jersey shirts with virtual reality features to show a user how the multi-team jersey will look on the user 110. Applying a QR code of the customized multi-team sports jersey shirt order on the back of the inside of the shirt neck is the QR code 115. The QR code facilitates the user sharing the design with others 120 of one embodiment.

DETAILED DESCRIPTION

Figure 2:
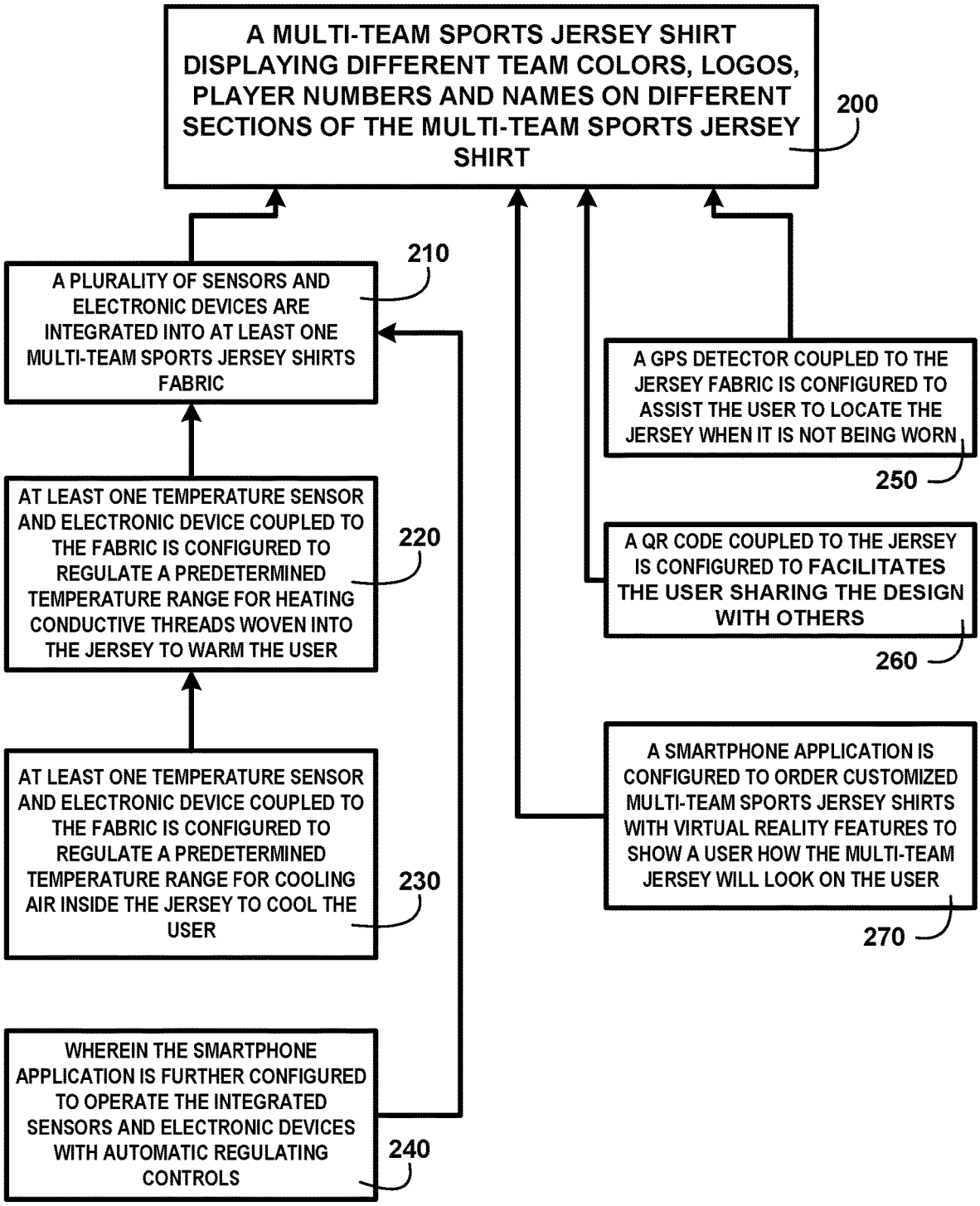
FIG. 2 shows a block diagram of an overview of a plurality of sensors and electronic devices of one embodiment.

FIG. 2 shows a block diagram of an overview of a plurality of sensors and electronic devices of one embodiment. FIG. 2 shows a multi-team sports jersey shirt displaying different team colors, logos, player numbers, and names on different sections of the multi-team sports jersey shirt 200. At least one multi-team sports jersey clothing fabric with color treatments for sports jersey clothing patterns with different sections in different sports team color selections. Multi-team sports jersey clothing fabric with hydrophobic treatment for water resistance.

A plurality of sensors and electronic devices are integrated into at least one multi-team sports jersey shirt fabric 210. At least one temperature sensor and an electronic device coupled to the fabric are configured to regulate a predetermined temperature range for heating conductive threads woven into the jersey to warm the user 220.

At least one temperature sensor and an electronic device coupled to the fabric are configured to regulate a predetermined temperature range for cooling air inside the jersey to cool the user 230. The smartphone app is further configured to operate the integrated sensors and electronic devices with automatic regulating controls 240. A plurality of sensors is integrated into smart fibers woven into the first and second sports jersey sections.

A GPS detector coupled to the jersey fabric is configured to assist the user to locate the jersey when it is not being worn 250. A QR code coupled to the jersey is configured to facilitate the user sharing the design with others 260. A smartphone app configured to order customized multi-team sports jersey shirts with virtual reality features to show a user how the multi-team jersey will look on the user 270 of one embodiment.

Figure 3:
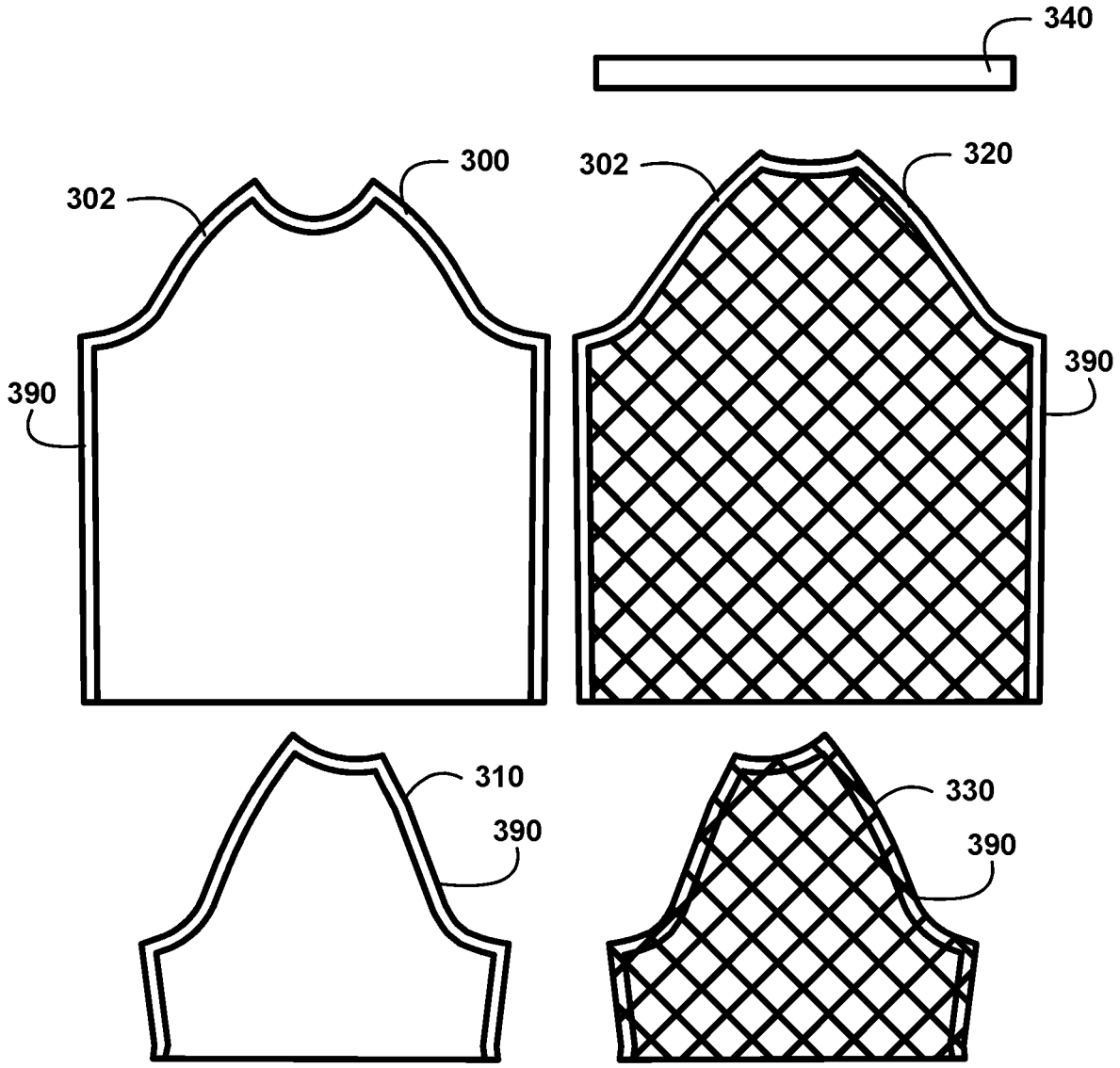
FIG. 3 shows for illustrative purposes only an example of a multi-team sports jersey clothing pattern of one embodiment.

Multi-Team Sports Jersey Clothing Pattern:

FIG. 3 shows for illustrative purposes only an example of a multi-team sports jersey clothing pattern of one embodiment. FIG. 3 shows a multi-team sports jersey shirt front 300 and multi-team sports jersey shirt right sleeve 310 patterns. Seams are sewn using a raw edge 302 of the cut sections. The front panel and right sleeve will display the first team selected by the user. Also seen in FIG. 3 is the multi-team sports jersey shirt back panel 320 and multi-team sports jersey shirt left sleeve 330. The back and left sleeve will display a second team selected by the user. The multi-team sports jersey shirt neckpiece 340 joins the front and back of the shirt at the neckline. Stitching is made along the seams 390 of the pattern. A stitched seam is separating first and second sections of the sports jersey from one another of one embodiment.

Figure 4A:
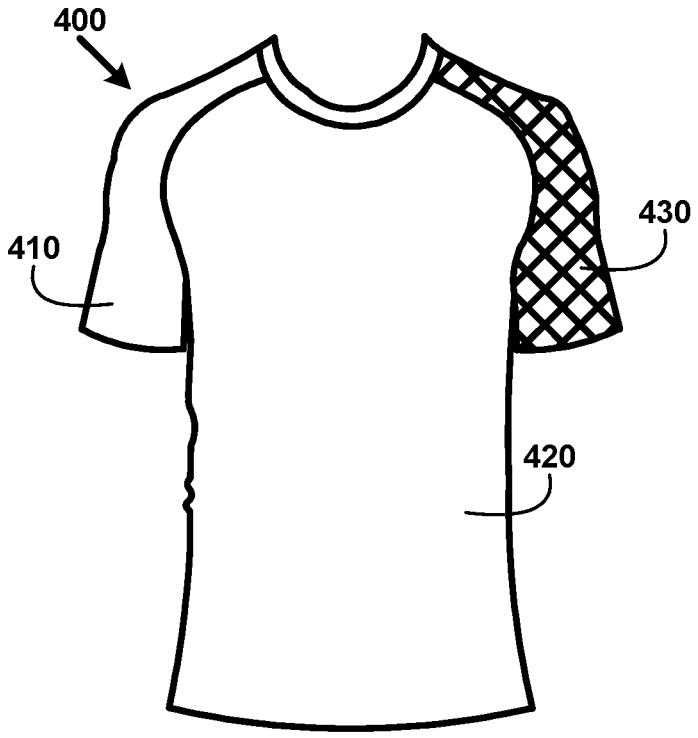
FIG. 4A shows for illustrative purposes only an example of a multi-team sports jersey shirt in front of one embodiment.

Multi-Team Sports Jersey Shirt Front:

FIG. 4A shows for illustrative purposes only an example of a multi-team sports jersey shirt in front of one embodiment. FIG. 4A shows the multi-team sports jersey shirt front sewn 400 including the front panel 420 and right sleeve 410 that will display first-team colors, players, and other first-team information. The left sleeve 430 will display at least a second team color of one embodiment.

The front and back sections of the multi-team sports jersey shirt can also include the commemorative insignia of special sporting events. For example, the Super Bowl football championship with roman numerals i.e. "Super Bowl LVI" and the city where the game is being played with the name of the stadium. In one embodiment the front section would display the Super Bowl commemorative insignia and the back section the name and insignia of the team the user is cheering for to win. A commemorative section that includes championship commemorative insignia with indicia of a year of a championship event, wherein the first and second player numbers and the championship commemorative insignia are stitched as appliqués. Other special sports events include the Stanley Cup Finals hockey championship, World Series baseball championship, World Cup soccer championship, NBA Finals basketball championship, and other special sports events.

Other special sports events can include College Bowl football games. For example the Rose Bowl, the Army-Navy NCAA football game, Fiesta Bowl, and many others. The Little League Baseball World Series where the front section displays the commemorative insignia of the series and the back section displays the user's hometown little league team.

In another embodiment, the multi-team sports jersey shirt displays on the front section the Olympics games five-ring Olympic insignia, city, and year of the games. This would include the summer and winter Olympic games. On the back section, particular sporting competitions can be displayed. For example, some of the Summer competitions i.e. the 100 m sprint, Gymnastics, Weightlifting, and other competitions the user is interested in watching. The Winter Olympics competitions include for example, Speed Skating, Ski Jumping, Curling, Luge, and other competitions the user is interested in watching. Other special sports events the user may wish to support include the Special Olympics, local Little League Baseball events and teams, and Pop Warner Football Super Bowl of one embodiment.

Figure 4B:
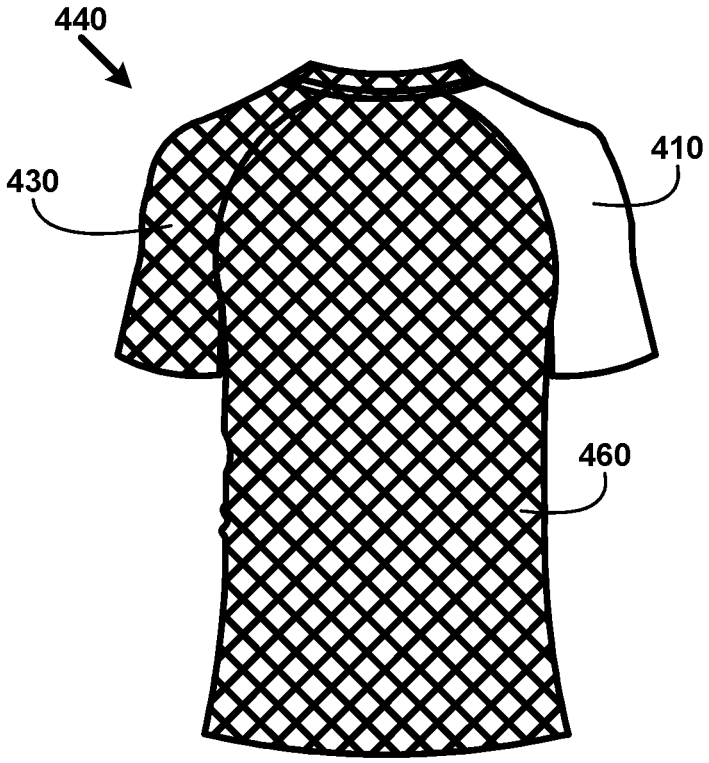
FIG. 4B shows for illustrative purposes only an example of a multi-team sports jersey shirt back of one embodiment.

Multi-Team Sports Jersey Shirt Back:

FIG. 4B shows for illustrative purposes only an example of a multi-team sports jersey shirt back of one embodiment. FIG. 4B shows the multi-team sports jersey shirt back sewn 440 including the left sleeve 430, back panel 460, and right sleeve 410. The back panel 460 and the left sleeve 430 display a second team color, player, and other second-team information. The right sleeve 410 will display at least a first-team color of one embodiment.

Figure 5A:
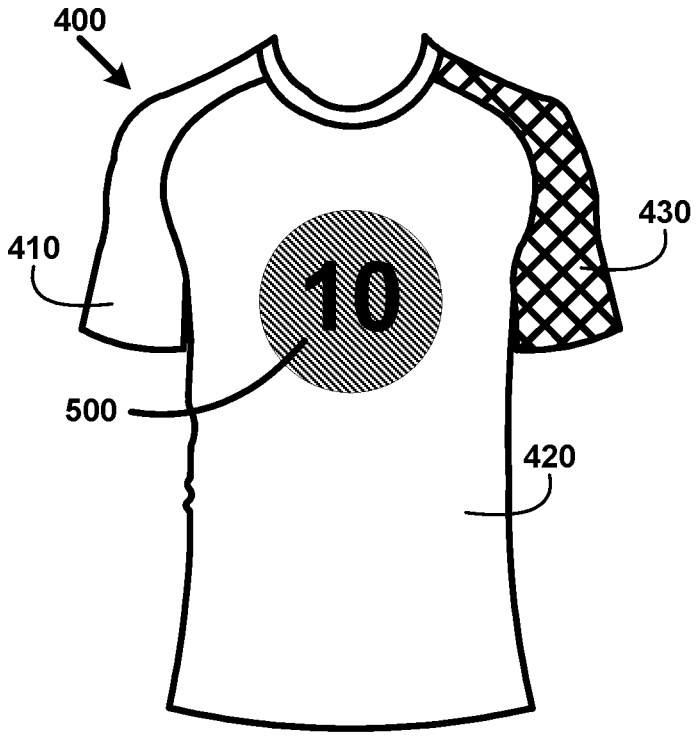
FIG. 5A shows for illustrative purposes only an example of a multi-team sports jersey shirt front with a player number of one embodiment.

Multi-Team Sports Jersey Shirt Front with Player Number:

FIG. 5A shows for illustrative purposes only an example of a multi-team sports jersey shirt front with a player number of one embodiment. FIG. 5A shows the multi-team sports jersey shirt front sewn 400 including the right sleeve 410 and front panel 420 displaying a first player number 500. A second team color will be displayed on the left sleeve 430.

A sports jersey pattern seam stitching protocol is configured to create a vivid contrast in two different team colors. A fabric of each section seam is joined in complementary folds with interior stitching thread that is not seen that creates a clear demarcation of the two colors. Stitching of seams of the front section panel to the right sleeve section and the back section panel to the left sleeve section are each made with team color matching colored thread. Section seam stitching on one fabric uses threads that match the color of the fabric. Stitching of appliqués of player numbers, team names, and commemorative insignia of special sporting events are stitched to the chosen sports jersey pattern section with thread matching the underlying fabric color. Multi-team sports jersey pattern sections in different user sizes for different clothing styles including jersey shirts, hoodies, long and short-sleeved shirts, sweat pants, shorts, hats, and other clothing styles of one embodiment.

Figure 5B:
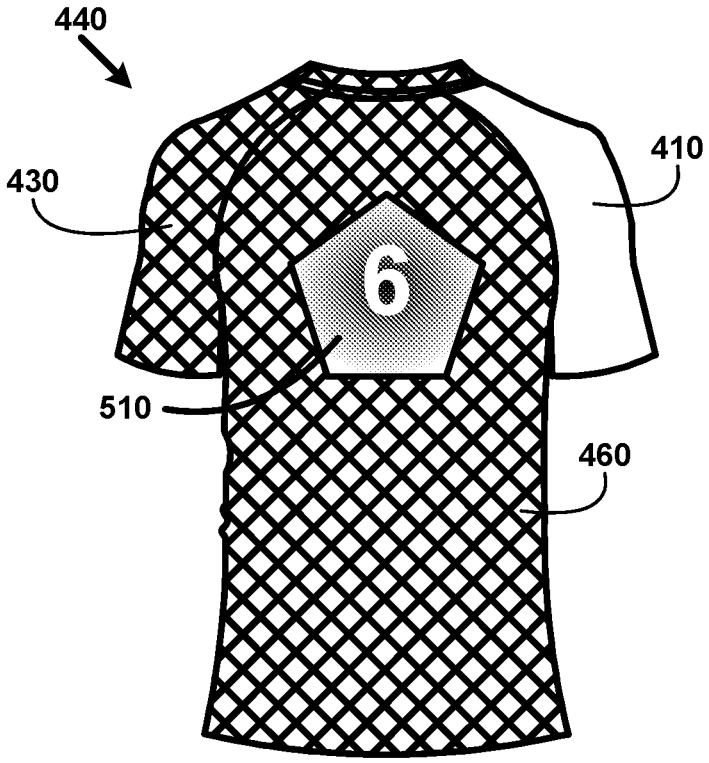
FIG. 5B shows for illustrative purposes only an example of a multi-team sports jersey shirt back with a player number of one embodiment.

Multi-Team Sports Jersey Shirt Back with Player Number:

FIG. 5B shows for illustrative purposes only an example of a multi-team sports jersey shirt back with a player number of one embodiment. FIG. 5B shows the multi-team sports jersey shirt back sewn 440 including the left sleeve 430 and back panel 460 displaying the second team color and a second player number 510. A first-team color is displayed on the right sleeve 410 of one embodiment.

Figure 6A:
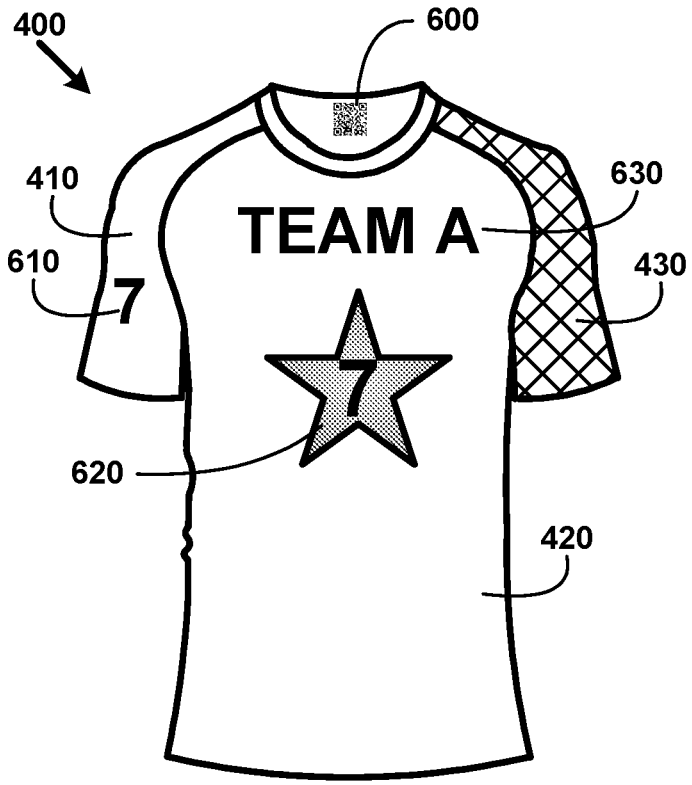
FIG. 6A shows for illustrative purposes only an example of a multi-team sports jersey shirt front with player number, team name, and logo of one embodiment.

Multi-Team Sports Jersey Shirt Front with Player Number, Team Name, and Logo:

FIG. 6A shows for illustrative purposes only an example of a multi-team sports jersey shirt front with player number, team name, and logo of one embodiment. FIG. 6A shows the multi-team sports jersey shirt front sewn 400 including the right sleeve 410, front panel 420, and left sleeve 430. The front panel 420 displays the first team color, first player number 610, Team A logo 620, and Team A 630 name. On the back of the inside of the shirt neck is the QR code 600 facilitating the user to share the pattern with another person.

In one embodiment the team logo, name, colors, and other identifying symbols are represented of one embodiment.

Figure 6B:
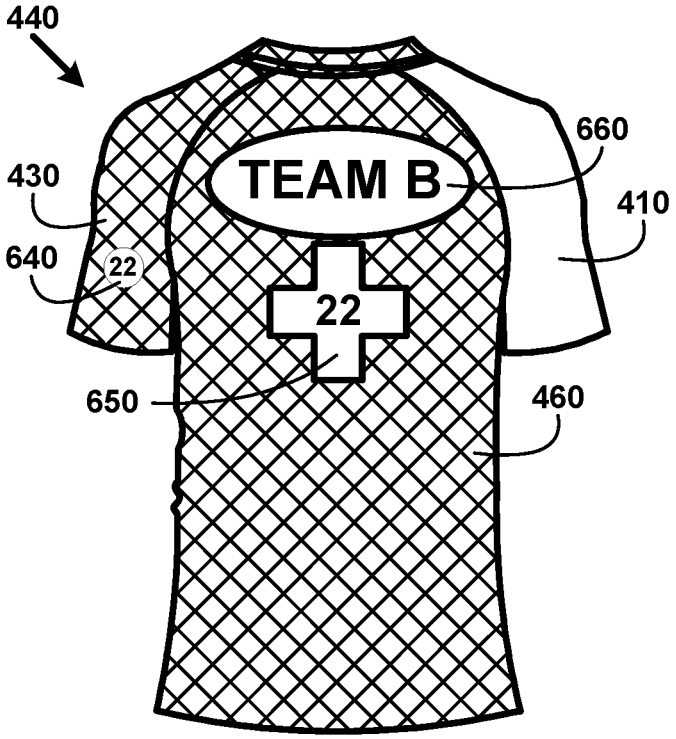
FIG. 6B shows for illustrative purposes only an example of a multi-team sports jersey shirt back with player number, team name, and logo of one embodiment.

Multi-Team Sports Jersey Shirt Back with Player Number, Team Name, and Logo:

FIG. 6B shows for illustrative purposes only an example of a multi-team sports jersey shirt back with player number, team name, and logo of one embodiment. FIG. 6B shows a multi-team sports jersey shirt back sewn 440 including the left sleeve 430 and back panel 460 displaying the second team. The right sleeve 410 is displaying at least the first team color. The left sleeve 430 is displaying the second player number 640. The back panel 460 displays a Team B logo 650 and Team B 660 name. In one embodiment a sports team insignia refers to a combination of a sports team logo, team colors, a player number, and any other symbols identifying the sports team of one embodiment.

Figure 7:
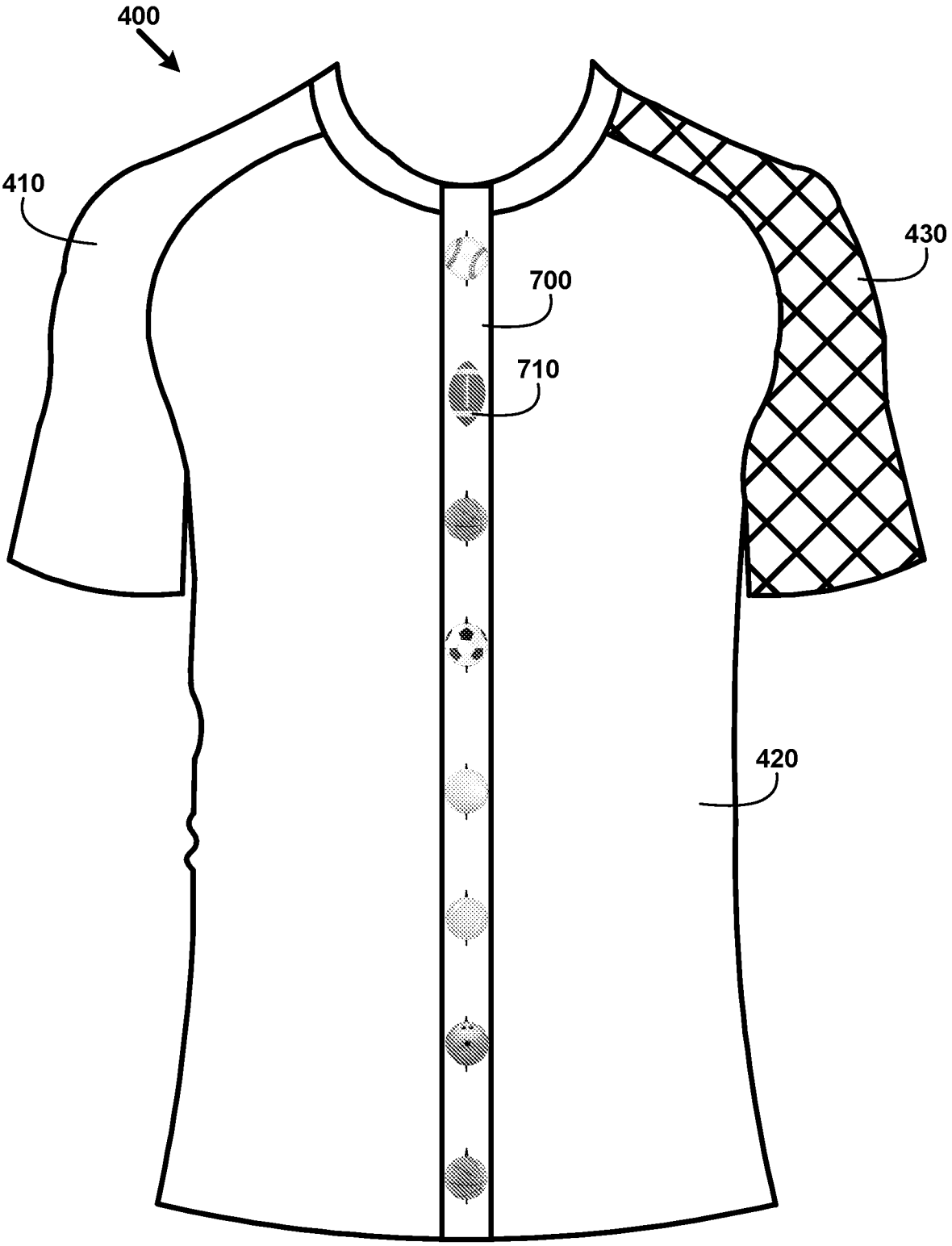
FIG. 7 shows for illustrative purposes only an example of a multi-team sports jersey shirt front with sports equipment buttons of one embodiment.

Multi-Team Sports Jersey Shirt Front with Sports Equipment Buttons:

FIG. 7 shows for illustrative purposes only an example of a multi-team sports jersey shirt front with sports equipment buttons of one embodiment. FIG. 7 shows the multi-team sports jersey shirt front sewn 400, the left sleeve 430, and the right sleeve 410. FIG. 7 shows a conductive thread buss 700 to conduct power to the sports button rechargeable battery compartment 710. The conductive thread buss 700 distributes power to the individual sports button rechargeable battery compartment 710 when recharging. The conductive thread buss 700 conducts power to conductive threads to energize the heating and cooling functions.

A thermal conductive thread is interwoven into the fabric of the clothing and configured to generate heat with power from a plurality of rechargeable batteries when ambient temperatures are cold. A micro-tubing integrated into the fabric of the clothing is configured to convey with a micro-pump a cooling fluid that absorbs body heat and dissipates the heat outside of the clothing to cool the user when ambient temperatures are hot. At least one micro-thermostat with adjustable temperature settings coupled to the thermal conductive thread heating system and the micro-tubing cooling system configured to regulate clothing temperatures within a predetermined range set by the user with a wirelessly coupled smartphone app of one embodiment.

Figure 8A:
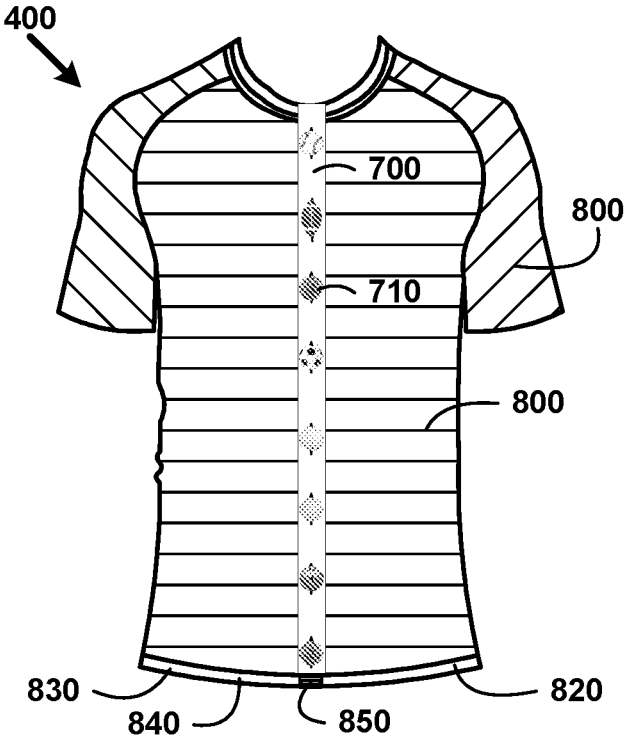
FIG. 8A shows for illustrative purposes only an example of a multi-team sports jersey shirt front with sports equipment buttons and conductive threads of one embodiment.

Multi-Team Sports Jersey Shirt Front with Sports Equipment Buttons and Conductive Threads:

FIG. 8A shows for illustrative purposes only an example of a multi-team sports jersey shirt front with sports equipment buttons and conductive threads of one embodiment. FIG. 8A shows the multi-team sports jersey shirt front sewn 400 with the conductive thread buss 700 and plurality of sports button rechargeable battery compartment 710 connected to the buss. The conductive thread buss 700 is coupled to a USB recharging port 850 for recharging the plurality of sports button rechargeable battery compartment 710 batteries. In one embodiment the threads are infrared fiber heating elements. In another embodiment, the sports button rechargeable batteries are lithium-ion batteries. In yet another embodiment the multi-team sports jersey shirt and other clothing have a cotton insulation layer liner.

Each conductive thread 800 is connected to the temperature regulator 830. The temperature regulator 830 regulates the voltage and amperage to raise and lower temperatures of the multi-team sports jersey shirt within a temperature range set by the user with the smartphone app. A communication device 820 coupled to the bottom cuff of the shirt receives signals from the smartphone app. The communication device 820 also transmits signals from the GPS locator 840 in both WIFI and cellular to send GPS location capability to capture coordinates of the multi-team sports jersey shirt for user locating purposes of one embodiment.

Figure 8B:
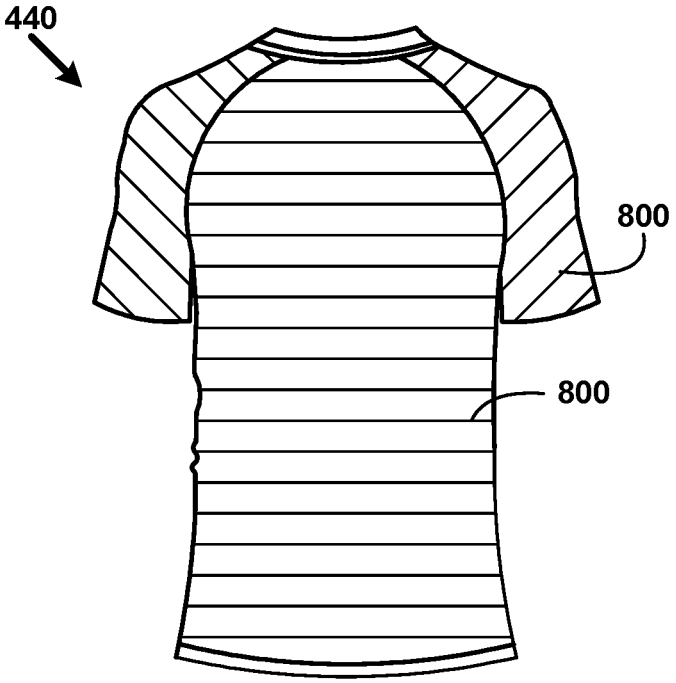
FIG. 8B shows for illustrative purposes only an example of a multi-team sports jersey shirt front with conductive threads of one embodiment.

Multi-Team Sports Jersey Shirt Front with Conductive Threads:

FIG. 8B shows for illustrative purposes only an example of a multi-team sports jersey shirt front with conductive threads of one embodiment. FIG. 8B shows the multi-team sports jersey shirt back sewn 440 with a thermal conductive thread 800 interwoven into the fabric. In one embodiment the thermal conductive thread 800 includes infrared fiber heating elements. In another embodiment, the fabric includes Polyamide fiber threads interwoven with the thermal conductive thread 800. The temperature of the shirt is regulated to warm the user in cold conditions and cool the user in hot conditions.

In yet another embodiment the multi-team sports jersey shirt and other clothing include micro-tubing sewn into the fabric to convey with a micro pump a cooling fluid that absorbs body heat and dissipates the heat outside of the clothing with a micro-fan therein cooling the fluid to absorb heat repeatedly. A micro-thermostat with adjustable temperature settings regulates the cooling temperature within a predetermined range set by the user with the wirelessly coupled smartphone app on the user's mobile device of one embodiment.

Figure 9A:
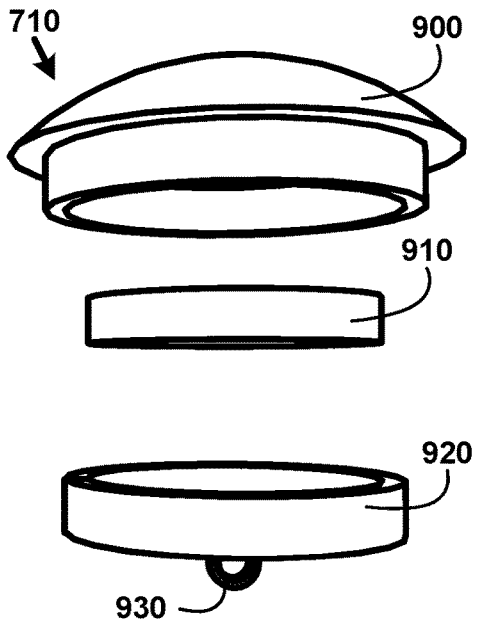
FIG. 9A shows for illustrative purposes only an example of sports button components of one embodiment.

Sports Button Components:

FIG. 9A shows for illustrative purposes only an example of sports button components of one embodiment. FIG. 9A shows the elements of the sports button rechargeable battery compartment 710 including the sports equipment cover 900. the Sports equipment covers 900 components include for example a baseball, football, soccer ball, tennis ball, and other sports equipment. Also showing is a rechargeable battery 910, a battery receiver 920, and a conductive connection 930 of one embodiment.

Figure 9B:
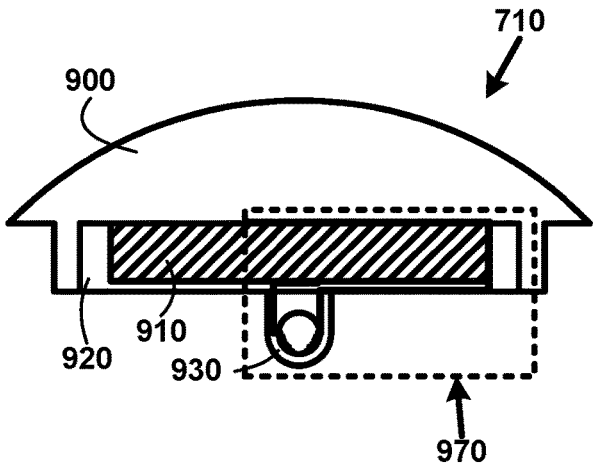
FIG. 9B shows for illustrative purposes only an example of a sports button assembly power supply of one embodiment.

Sports Button Assembly Power Supply:

FIG. 9B shows for illustrative purposes only an example of a sports button assembly power supply of one embodiment. FIG. 9B shows the sports button rechargeable battery compartment 710 with the elements connected in a power conductive mode. The sports equipment cover 900 is interchangeable with the battery receiver 920. A user can select multiples of a single or another number of different sports equipment that cover 900 units. The rechargeable battery 910 installs into the battery receiver 920 wherein the conductive connection 930 is sewn to the conductive thread buss 700 of FIG. 7. The circuit connections are shown in a blow-up 970 in FIG. 9C of one embodiment.

Figure 9C:
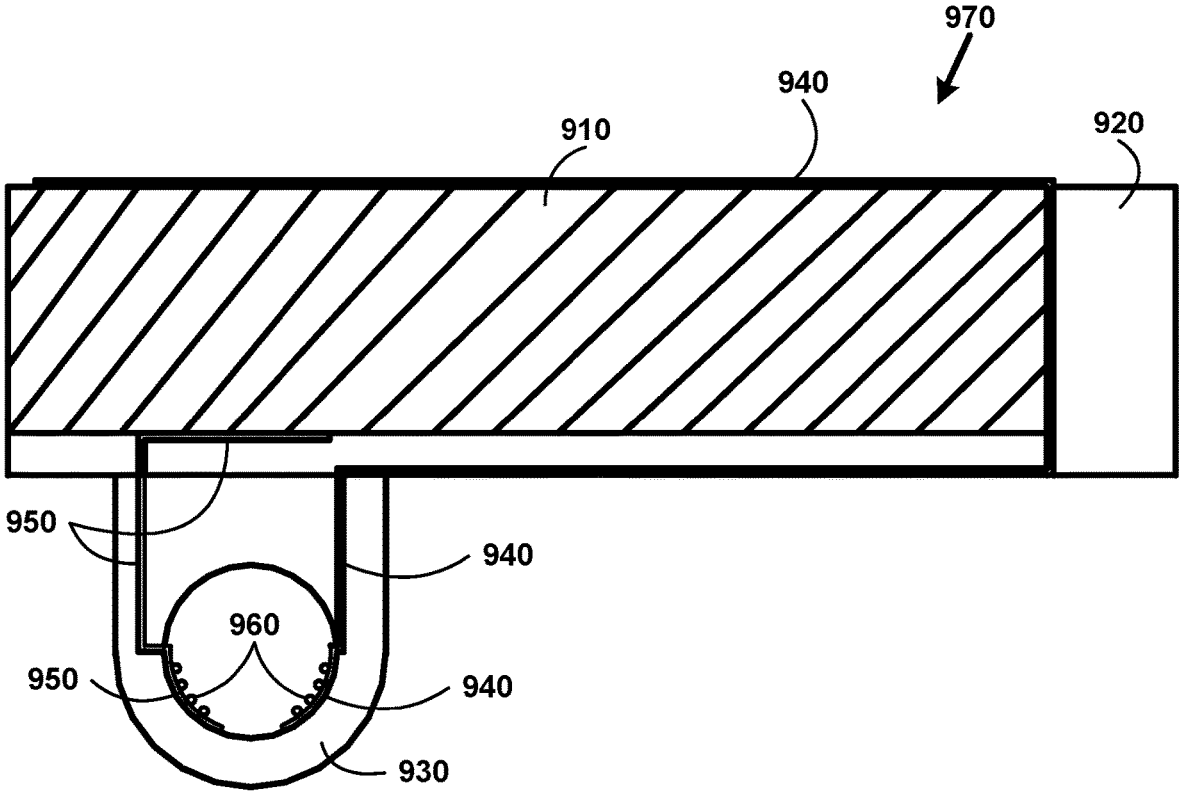
FIG. 9C shows for illustrative purposes only an example of a sports button rechargeable pattern and wiring of one embodiment.

Sports Button Rechargeable Pattern and Wiring:

FIG. 9C shows for illustrative purposes only an example of a sports button rechargeable pattern and wiring of one embodiment. FIG. 9C shows the blow-up 970 of the circuit connections showing the rechargeable battery 910 set into the battery receiver 920. The conductive connection 930 is the structure with which the buttons are attached to the conductive thread buss 700 of FIG. 7. A battery-positive conductor 940 from the top of the rechargeable battery 910 is routed to the conductive connection 930. A battery negative conductor 950 from the bottom of the rechargeable battery 910 is routed to the conductive connection 930 on the opposite side to the battery positive conductor 940 circuit conductors.

The conductive connection 930 is used for a sewn connection using conductive threads connecting to the battery conductors 960 to complete circuits for power conduction to and from the plurality of the rechargeable battery 910 units. Other electronic devices, including piezo electrical sources, also connect to the plurality of the rechargeable battery 910 units through the conductive thread buss 700 of FIG. 7 extended in the bottom cuff of the shirt of one embodiment.

Figure 10:
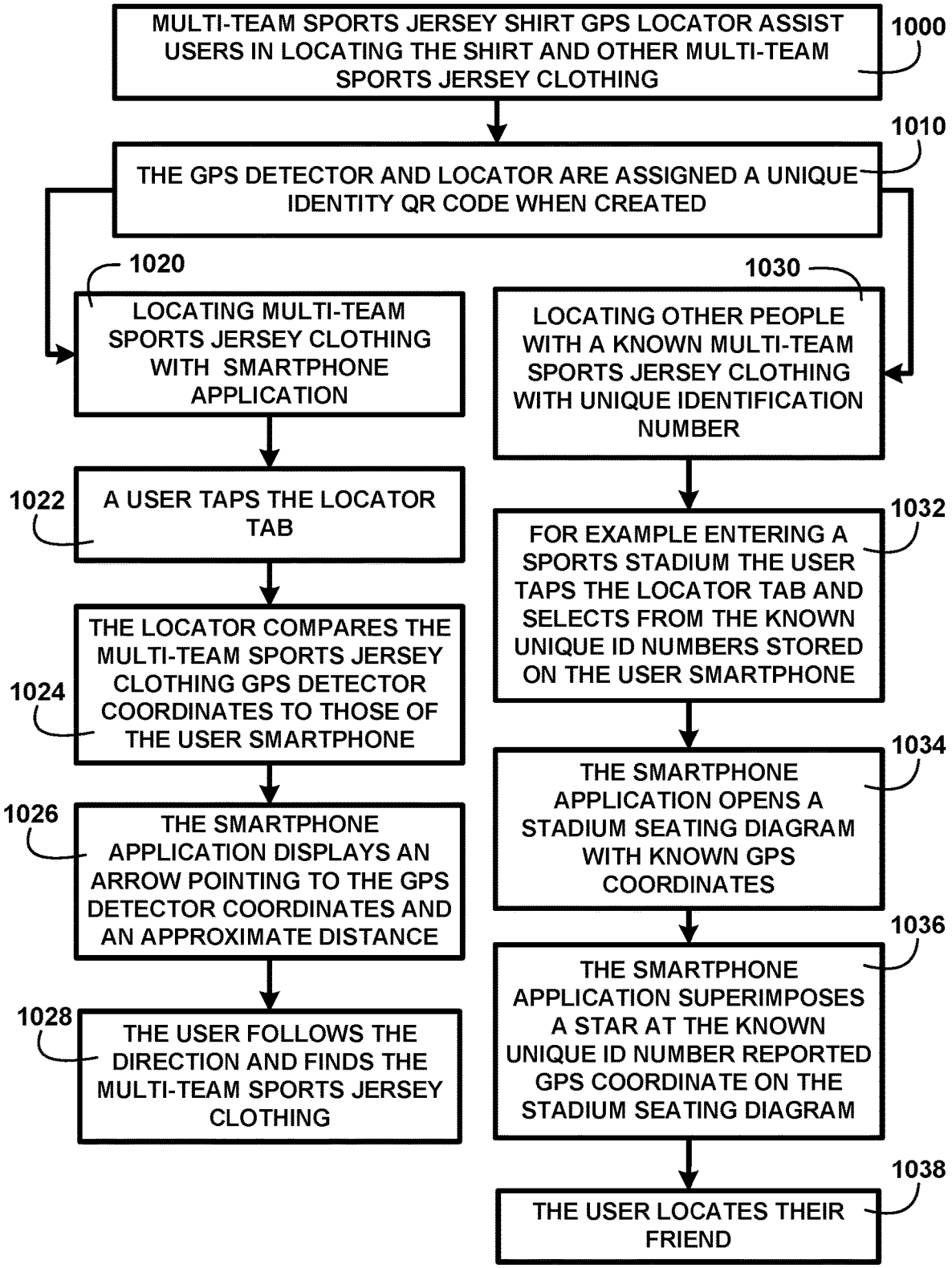
FIG. 10 shows a block diagram of an overview of a multi-team sports jersey shirt GPS locator of one embodiment.

Multi-Team Sports Jersey Shirt GPS Locator:

FIG. 10 shows a block diagram of an overview of a multi-team sports jersey shirt GPS locator of one embodiment. FIG. 10 shows the multi-team sports jersey shirt GPS locator assists users in locating the shirt and other multi-team sports jersey clothing 1000. The GPS detector and locator are assigned a unique identity QR code when created 1010. Locating multi-team sports jersey clothing with smartphone app 1020. A user taps the locator tab 1022. The locator compares the multi-team sports jersey clothing GPS detector coordinates to those of the user smartphone 1024. The smartphone app displays an arrow pointing to the GPS detector coordinates and an approximate distance 1026. The user follows the direction and finds the multi-team sports jersey clothing 1028.

Locating other people with a known multi-team sports jersey clothing with unique identification number 1030. For example, entering a sports stadium the user taps the locator tab and selects from the known unique id numbers stored on the user's smartphone 1032. The smartphone app opens a stadium seating diagram with known GPS coordinates 1034. The smartphone app superimposes a star at the known unique id number reported GPS coordinate on the stadium seating diagram 1036. The user locates their friend 1038 of one embodiment.

Figure 11:
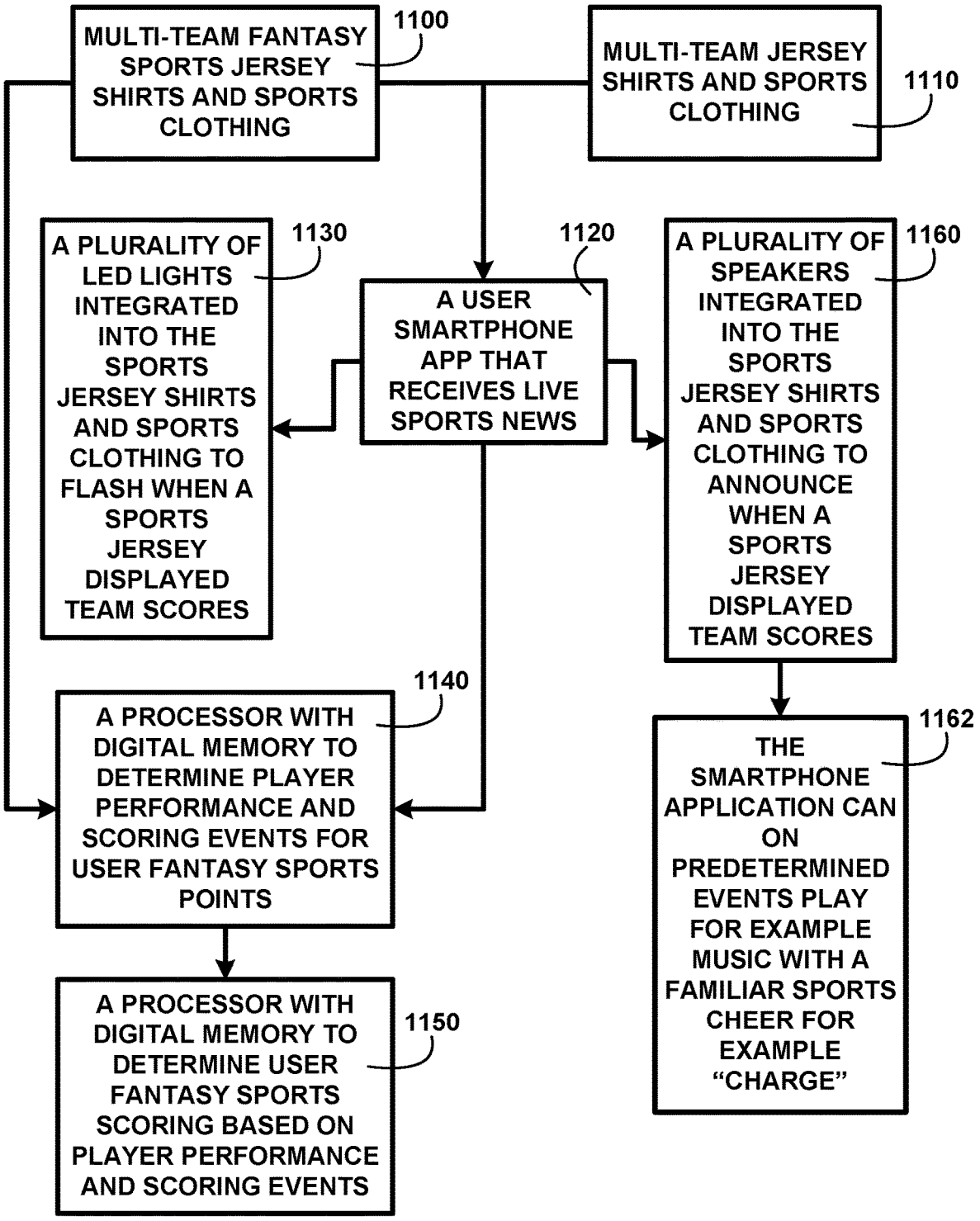
FIG. 11 shows a block diagram of an overview of multi-team fantasy sports jersey shirts and clothing of one embodiment.

Fantasy Sports:

FIG. 11 shows a block diagram of an overview of multi-team fantasy sports jersey shirts and clothing of one embodiment. FIG. 11 shows multi-team fantasy sports jersey shirts and sports clothing 1100 in addition to multi-team jersey shirts and sports clothing 1110. In one embodiment a multi-team fantasy sports jersey shirt is configured for example, with a first fantasy player picking a name and the user's fantasy team name on the front panel, and a second fantasy player picks a name and the user's fantasy team name on the back panel.

Alerts including flashing lights and audio messages are made when the first or second fantasy player scores or makes a significant play. The alerts are also made when the user's fantasy team members score or make a significant play. The fantasy team score is audio announced at the change of quarters, innings, or another standard game interval. In yet another embodiment the smartphone app upon user request will display the fantasy team roster with the stats for each player for the current game and a compilation of the season stats for each player on the fantasy team with a ranking against other fantasy team players in the fantasy league.

A user smartphone app that receives live sports news 1120. A plurality of illumination devices, for example, LED lights, integrated into the sports jersey shirts and sports clothing to flash when a sports jersey displays team scores 1130. The plurality of illumination devices are configured to flash a first color when the first sports team scores, and to flash a second color when the second sports team scores, based on the mobile app transmitted alerts of sports team events activation of sensors dedicated to turn on a color for a predetermined time. A processor with digital memory is used to determine player performance and scoring events for user fantasy sports points 1140. A processor with digital memory to determine user fantasy sports scoring based on player performance and scoring events 1150. A plurality of speakers integrated into the sports jersey shirts and sports clothing to announce when a sports jersey displayed team scores 1160. In one embodiment the smartphone app can on predetermined events play for example music with a familiar sports cheer for example "charge" 1162.

In another example, the user selects prerecorded videos and music to play in a fantasy half-time show on the smartphone app. The smartphone app facilitates the user to manage their chosen fantasy team players. For example, the user can select a starting pitcher, a starting quarterback, a starting hockey goalie, or a starting forward on a soccer team and substitute during the game or match. The smartphone app facilitates the user-manager to make fantasy free-agent pickups and trades.

A fantasy sport is a game, played using the Internet, where fantasy sport participants assemble imaginary or virtual teams composed of proxies of real players of at least one professional sport. The outcome of a fantasy game is determined by actual results of player's performance in real live professional sport events. In fantasy sports, as in real sports fantasy sport participant team owners can draft, trade, and cut players of one embodiment.

Figure 12:
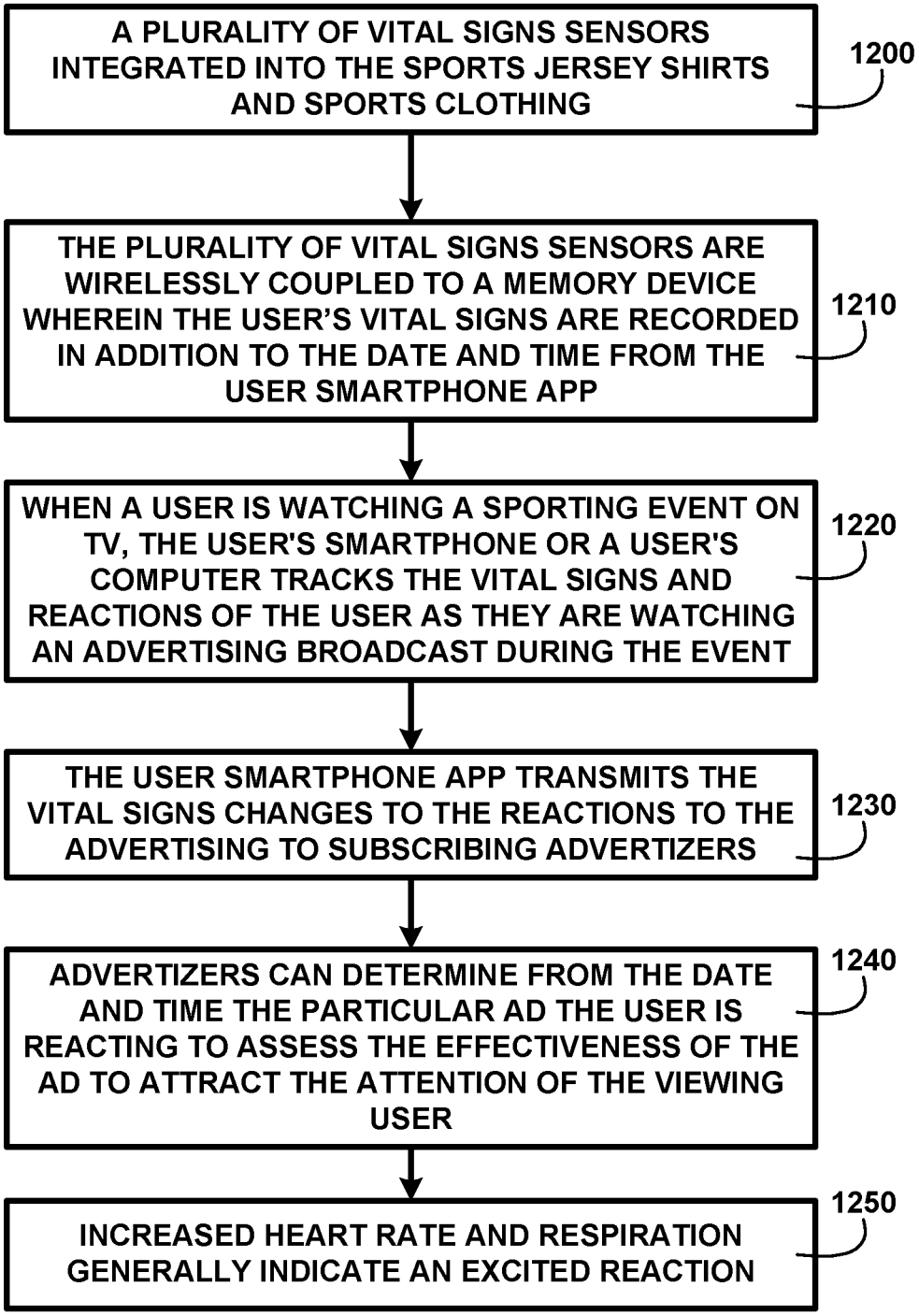
FIG. 12 shows a block diagram of an overview of multi-team sports jersey shirts and clothing advertising of one embodiment.

Advertising:

FIG. 12 shows a block diagram of an overview of multi-team sports jersey shirts and clothing advertising of one embodiment. FIG. 12 shows a plurality of vital signs sensors integrated into the sports jersey shirts and sports clothing 1200. The plurality of vital signs sensors are wirelessly coupled to a memory device wherein the user's vital signs are recorded in addition to the date and time from the user's smartphone app 1210. When a user is watching a sporting event on TV, the user's smartphone or a user's computer tracks the vital signs and reactions of the user as they are watching an advertising broadcast during the event 1220.

The user smartphone app transmits the vital signs changes to the reactions to the advertising to subscribing advertisers 1230. Advertisers can determine from the date and time the particular ad the user is reacting to assess the effectiveness of the ad to attract the attention of the viewing user 1240. Increased heart rate and respiration generally indicate an excited reaction 1250 by the user. Sports advertising has taken on its importance. Advertisers pay large sums of money to place ads for example Super Bowl ads. Viewers are watching, in some cases, just to see the ads. The user's reactions are a judge of the ad presentation since the multi-team sports jersey shirts and clothing wearer is an obvious sports enthusiast who will frequently be viewing the ads of one embodiment.

Figure 13:
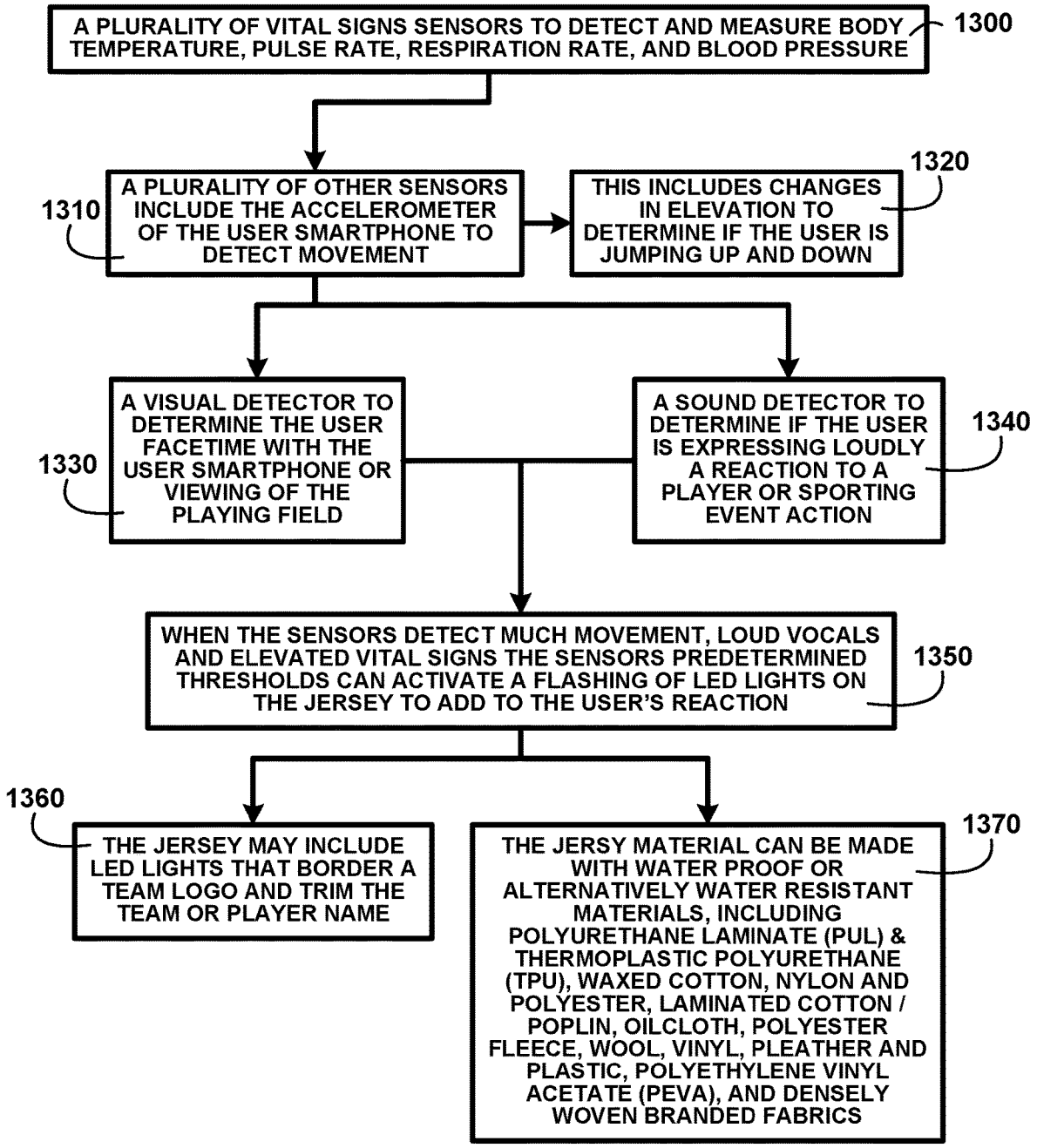
FIG. 13 shows a block diagram of an overview of multi-team sports jersey shirts and clothing vital signs sensing one embodiment.

Vital Signs Sensing:

FIG. 13 shows a block diagram of an overview of multi-team sports jersey shirts and clothing vital signs sensing of one embodiment. FIG. 13 shows a plurality of vital signs sensors to detect and measure body temperature, pulse rate, respiration rate, and blood pressure 1300. A plurality of other sensors includes the accelerometer of the user's smartphone to detect movement 1310. This includes elevation changes to determine if the user is jumping up and down 1320. A visual detector to determine the user's face time with the user's smartphone or viewing of the playing field 1330 tracks the user's eye movements. A sound detector to determine if the user is expressing loudly a reaction to a player or sporting event action 1340.

When the sensors detect much movement, loud vocals, and elevated vital signs the sensors' predetermined thresholds can activate a flashing of illumination devices on the jersey to add to the user's reaction 1350. The jersey may include illumination devices that border a team logo and trim the team or player name 1360. The jersey fabric material can be made with waterproof or water-resistant materials, including Polyurethane Laminate (PUL) & Thermoplastic Polyurethane (TPU), waxed cotton, nylon and polyester, laminated cotton/poplin, oilcloth, polyester fleece, wool, vinyl, pleather and plastic, polyethylene vinyl acetate (PEVA), and densely woven branded fabrics 1370.

Waterproof and water-resistant fabrics prevent rain from short-circuiting digital and electronic sensors, illumination devices, and other electrical components. A mobile app wirelessly coupled to a plurality of sensors to transmit alerts to a user from the mobile app via the plurality of sensors.

In one embodiment a plurality of illumination devices integrated into the sports jersey shirts and sports clothing is configured to flash when a sports jersey displays team related events.

Figure 14:
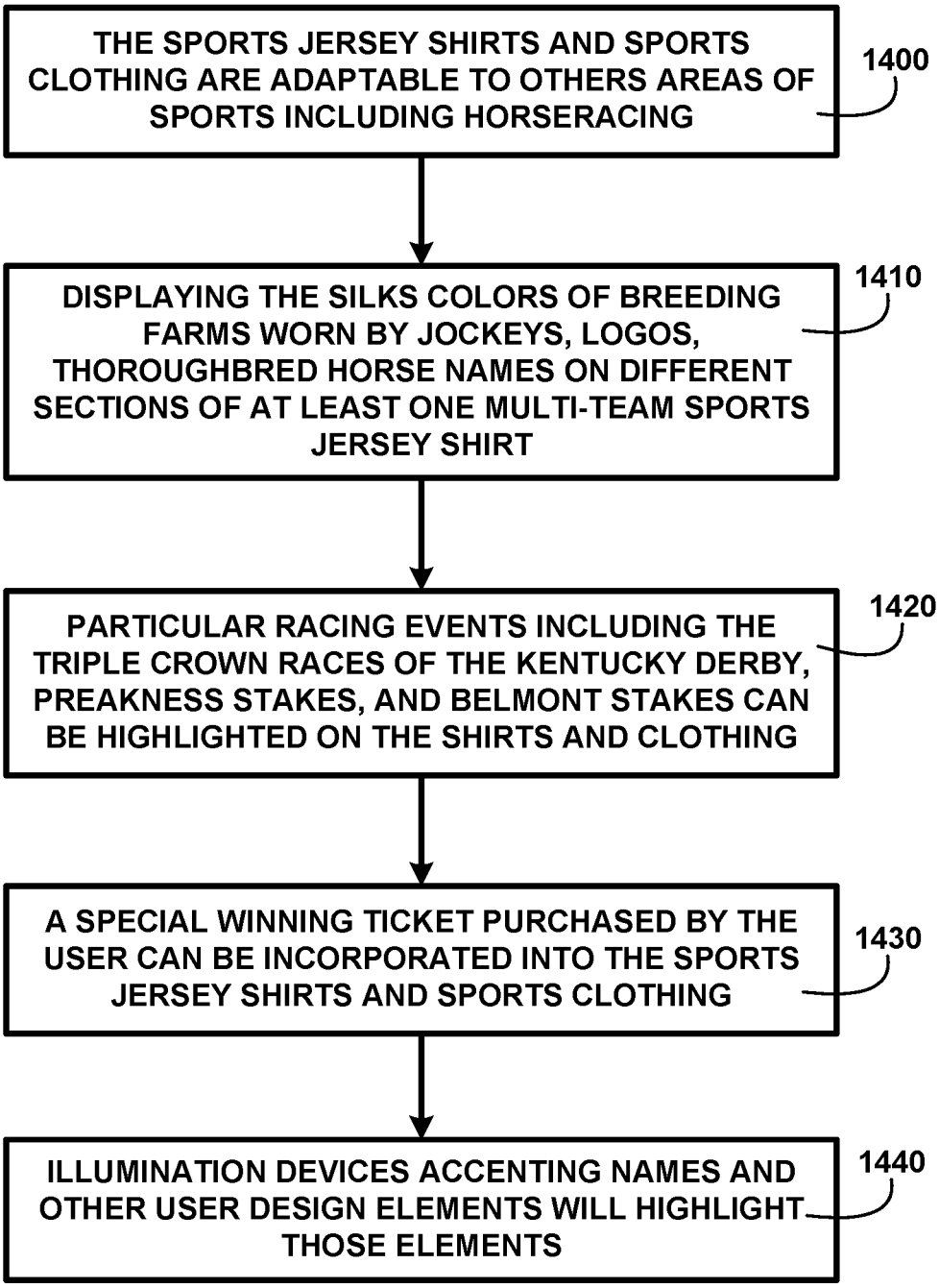
FIG. 14 shows a block diagram of an overview of multi-team sports jersey shirts and clothing horseracing applications of one embodiment.

Horseracing Applications:

FIG. 14 shows a block diagram of an overview of multi-team sports jersey shirts and clothing horseracing applications of one embodiment. FIG. 14 shows that sports jersey shirts and sports clothing are adaptable to others areas of sports including horseracing 1400. Other areas of sports include hockey, rugby, cricket, bowling, racecar events, and sports fishing.

In this example of horseracing, the sports jersey shirts and sports clothing can be displaying the silks colors of breeding farms worn by jockeys, and thoroughbred horse names on different sections of at least one multi-team sports jersey shirt 1410. Particular racing events including the triple crown races of the Kentucky Derby, Preakness Stakes, and Belmont Stakes can be highlighted on the shirts and clothing 1420. The user may want to display a special winning ticket purchased by the user that can be incorporated into the sports jersey shirts and sports clothing 1430. Illumination devices accenting names and other useful design elements will highlight those elements 1440 of one embodiment.

Figure 15:
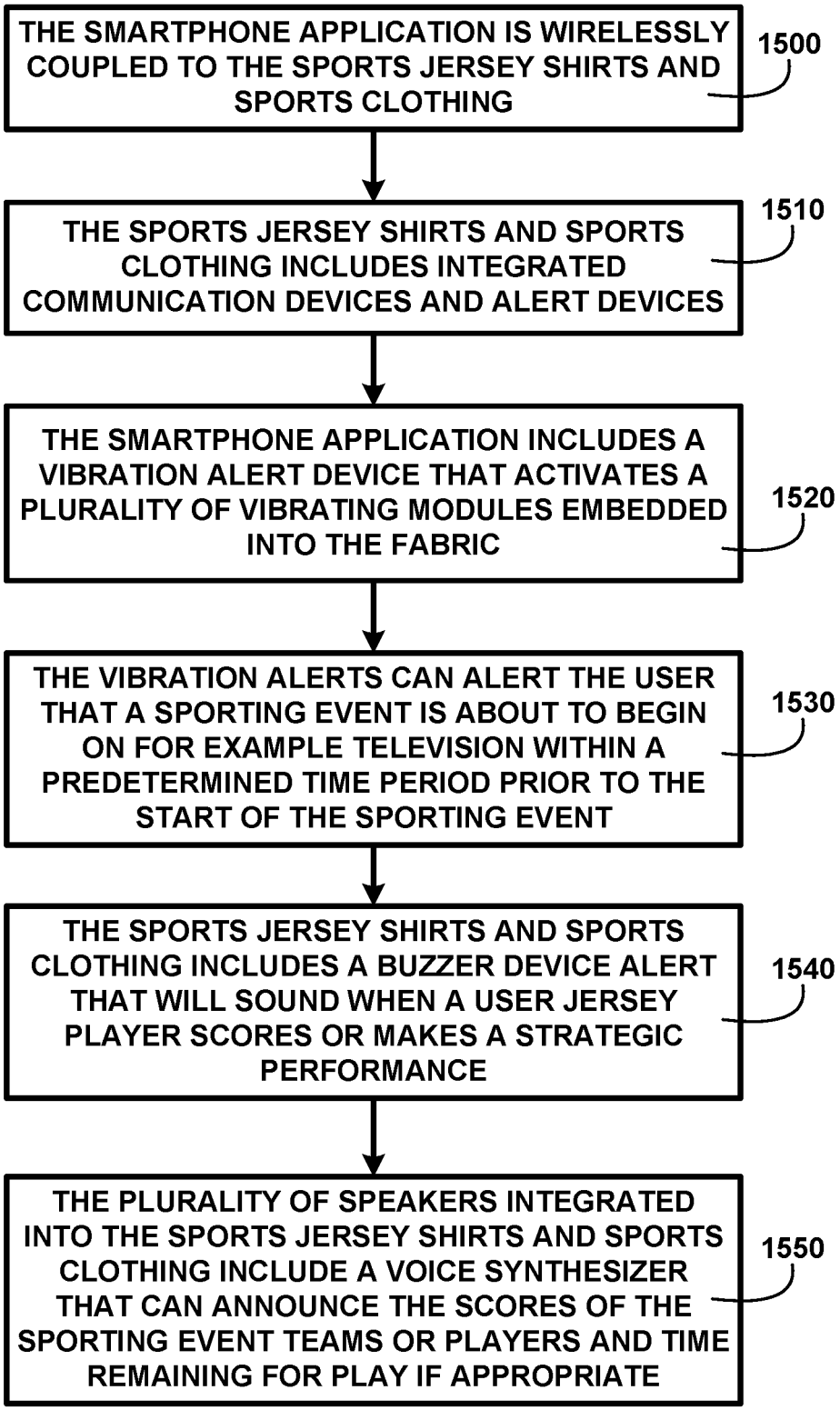
FIG. 15 shows a block diagram of an overview of multi-team sports jersey shirts and clothing alerts of one embodiment.

Alerts:

FIG. 15 shows a block diagram of an overview of multi-team sports jersey shirts and clothing alerts of one embodiment. FIG. 15 shows the smartphone app is wirelessly coupled to the sports jersey shirts and sports clothing 1500. The sports jersey shirts and sports clothing include integrated communication devices and alert devices 1510. The smartphone app includes a vibration alert device that activates a plurality of vibrating modules embedded into the fabric 1520. The vibration alerts can alert the user that a sporting event is about to begin on for example television within a predetermined time before the start of the sporting event 1530.

The sports jersey shirts and sports clothing includes a buzzer device alert that will sound when a user jersey player scores or makes a strategic performance 1540. The plurality of speakers integrated into the sports jersey shirts and sports clothing includes a voice synthesizer that can announce the scores of the sporting event teams or players and time remaining for play if appropriate 1550.

Figure 16:
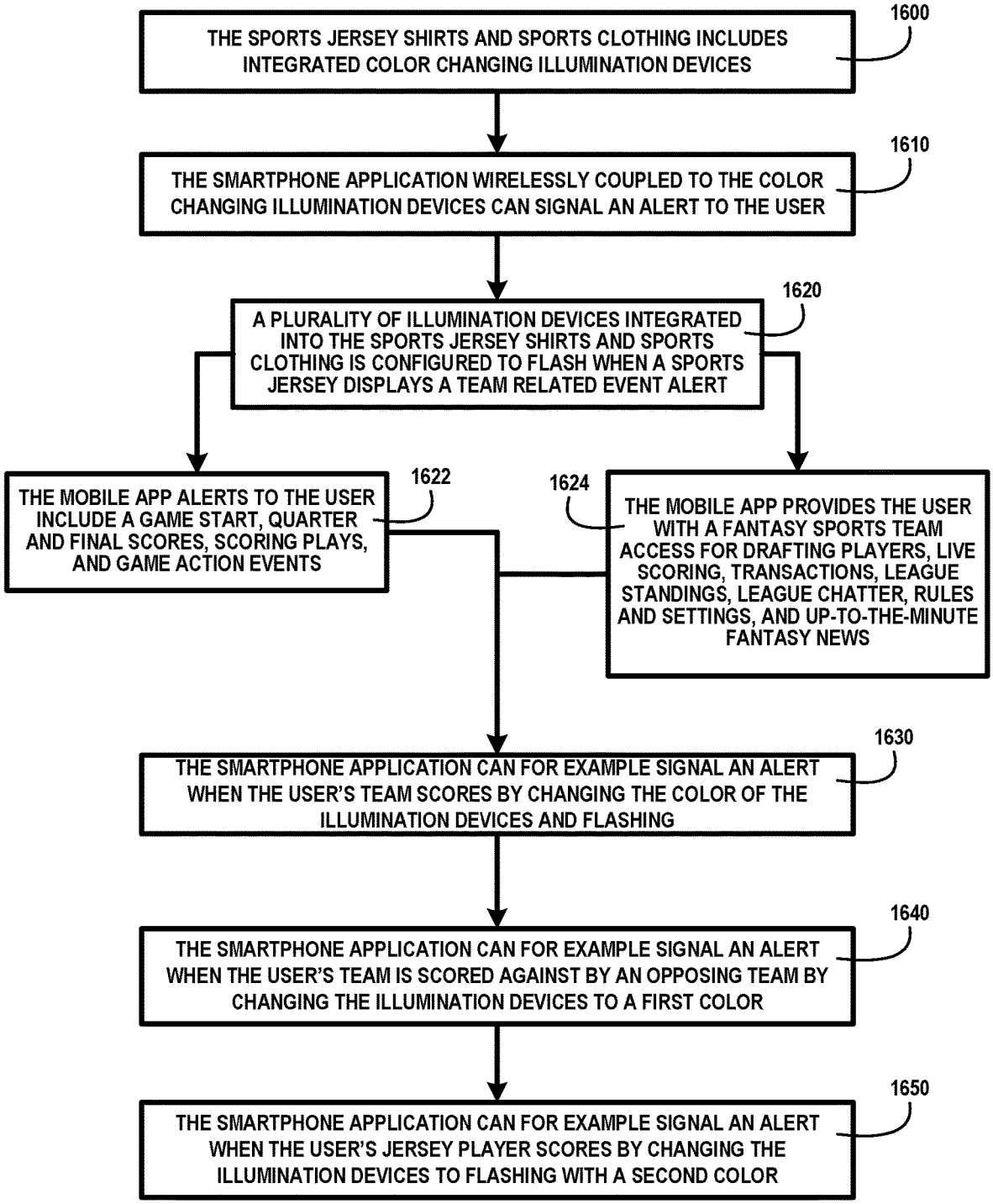
FIG. 16 shows a block diagram of an overview of multi-team sports jersey shirts and clothing color changing illuminating devices of one embodiment.

LED Lights Color Changing:

FIG. 16 shows a block diagram of an overview of multi-team sports jersey shirts and clothing color changing illuminating devices of one embodiment. FIG. 16 shows the sports jersey shirts and sports clothing includes integrated color changing illumination devices 1600. the smartphone app wirelessly coupled to the color changing illumination devices can signal an alert to the user 1610.

a plurality of color changing illumination devices integrated into the sports jersey shirts and sports clothing is configured to flash when a sports jersey displays a team related event alert 1620. The mobile app alerts to the user include a game start, quarter and final scores, scoring plays, and game action events 1622. In another embodiment the mobile app provides the user with a fantasy sports team access for drafting players, live scoring, transactions, league standings, league chatter, rules and settings, and up-to-the-minute fantasy news 1624.

The smartphone application can for example signal an alert when the user's team scores by changing the color of the illumination devices and flashing 1630. The smartphone application can for example signal an alert when the user's team is scored against by an opposing team by changing the illumination devices to a first color 1640. The smartphone application can for example signal an alert when the user's jersey player scores by changing the illumination devices to flashing with a second color 1650.

The foregoing has described the principles, embodiments, and modes of operation of the present invention. However, the invention should not be construed as being limited to the particular embodiments discussed. The above-described embodiments should be regarded as illustrative rather than restrictive, and it should be appreciated that variations may be made in those embodiments by workers skilled in the art without departing from the scope of the present invention as defined by the following claims.

What is claimed is:

1. A smart sports jersey, comprising:

a front panel having a first sleeve;

a back panel having a second sleeve, wherein the back panel is connected to the front panel via the first and second sleeves;

wherein the front panel and the first sleeve includes first insignia and the back panel and the second sleeve includes second insignia different from the first insignia;

a plurality of smart sensors and electronic devices integrated into the sports jersey configured to wirelessly send and receive signals to a mobile app installed on a mobile device; and wherein the mobile app is configured to wirelessly control, activate and send alerts to the plurality of sensors and electronic devices integrated into the sports jersey.

2. The smart sports jersey of claim 1, wherein the first insignia of the front panel and the first sleeve comprises a first color scheme for a first team and the second insignia of the back panel and the second sleeve comprises a second color scheme for the first team.

3. The smart sports jersey of claim 1, wherein the first insignia of the front panel and the first sleeve comprises a first team's insignia applique and the second insignia of the back panel and the second sleeve comprises a second team's insignia appliqué.

4. The smart sports jersey of claim 1, wherein the electronic devices include at least one of cooling devices, heating devices, illumination devices, sound producing devices, a power source or vibrating devices.

5. The smart sports jersey of claim 1, wherein the electronic devices include a plurality of illumination devices configured to illuminate automatically during a sports event based on the wireless control of the mobile app.

6. The smart sports jersey of claim 1, wherein the mobile app is further configured to control the plurality of electronic devices based on fantasy sports alerts.

7. The smart sports jersey of claim 1, wherein the electronic devices include a plurality of illumination devices configured to illuminate automatically during a sports event based on fantasy sports alerts wireless controlled by the mobile app.

8. A smart sports jersey, comprising:

a front panel having a first sleeve;

a back panel having a second sleeve, wherein the back panel is connected to the front panel via the first and second sleeves;

wherein the front panel and the first sleeve includes first insignia and the back panel and the second sleeve includes second insignia different from the first insignia;

a plurality of smart sensors and electronic devices integrated into the sports jersey configured to wirelessly send and receive signals to a mobile app installed on a mobile device;

wherein the mobile app is configured to wirelessly control, activate and send alerts to the plurality of sensors and electronic devices integrated into the sports jersey; and wherein the electronic devices include illumination devices and vibrating devices.

9. The smart sports jersey of claim 8, wherein the first insignia of the front panel and the first sleeve comprises a first home color scheme for a first team and the second insignia of the back panel and the second sleeve comprises a second away color scheme for the first team.

10. The smart sports jersey of claim 8, wherein the first insignia of the front panel and the first sleeve comprises a first team's insignia applique and the second insignia of the back panel and the second sleeve comprises a second team's insignia appliqué.

11. The smart sports jersey of claim 8, wherein the electronic devices further include at least one of cooling devices, heating devices or sound producing devices.

12. The smart sports jersey of claim 8, wherein the illumination devices are configured to illuminate automatically during a sports event based on fantasy sports alerts.

13. A smart sports jersey, comprising:

a front panel having a first sleeve;

a back panel having a second sleeve, wherein the back panel is connected to the front panel via the first and second sleeves;

wherein the front panel and the first sleeve includes first insignia and the back panel and the second sleeve includes second insignia different from the first insignia;

a plurality of smart sensors and electronic devices integrated into the sports jersey configured to wirelessly send and receive signals to a mobile app installed on a mobile device;

wherein the mobile app is configured to wirelessly control, activate and send alerts to the plurality of sensors and electronic devices integrated into the sports jersey; and wherein the electronic devices include illumination devices, vibrating devices and a power source.

14. The smart sports jersey of claim 13, wherein the first insignia of the front panel and the first sleeve comprises a first home color scheme for a first team and the second insignia of the back panel and the second sleeve comprises a second away color scheme for the first team.

15. The smart sports jersey of claim 13, wherein the first insignia of the front panel and the first sleeve comprises a first team's insignia applique and the second insignia of the back panel and the second sleeve comprises a second team's insignia appliqué.

16. The smart sports jersey of claim 13, wherein the electronic devices further include at least one of cooling devices, heating devices or sound producing devices.

17. The smart sports jersey of claim 13, wherein the illumination devices are configured to illuminate automatically during a sports event based on fantasy sports alerts.

18. The smart sports jersey of claim 13, wherein the illumination devices are configured to intermittently illuminate automatically during a sports event based on actions occurring during the sports event.

19. The smart sports jersey of claim 13, wherein the power source is a rechargeable battery source configured to provide power to the plurality of sensors and electronic devices.

20. The smart sports jersey of claim 13, wherein the plurality of sensors and electronic devices are removable from the sports jersey to allow washing of the sports jersey.

* * * * *